US007329218B2

(12) United States Patent
Kisch

(10) Patent No.: US 7,329,218 B2
(45) Date of Patent: Feb. 12, 2008

(54) FEED APPARATUS AND METHOD FOR FEEDING BLANKS INTO CONTAINER FORMING MACHINES

(76) Inventor: Raymond George Montague Kisch, 2170 Academy Ave., Sanger, CA (US) 93657

( * ) Notice: Subject to any disclaimer, the term of this patent is extended or adjusted under 35 U.S.C. 154(b) by 0 days.

(21) Appl. No.: 11/521,942

(22) Filed: Sep. 15, 2006

(65) Prior Publication Data

US 2007/0063416 A1 Mar. 22, 2007

Related U.S. Application Data

(60) Provisional application No. 60/756,885, filed on Jan. 5, 2006, provisional application No. 60/718,060, filed on Sep. 16, 2005.

(51) Int. Cl.
*B31B 1/04* (2006.01)
*B65B 43/08* (2006.01)

(52) U.S. Cl. ..... 493/309; 493/310; 53/456; 53/564

(58) Field of Classification Search ..... 493/309, 493/310, 311, 312, 313, 315, 317, 318, 319; 53/457, 381.1, 458, 382.1, 564, 389.1; 271/225, 271/277
See application file for complete search history.

(56) References Cited

U.S. PATENT DOCUMENTS 3,552,280 A * 1/1971 Jaroch ..... 493/319
4,537,587 A * 8/1985 Langen ..... 493/318
4,871,348 A 10/1989 Konaka
4,881,934 A * 11/1989 Harston et al. ..... 493/318
4,930,291 A * 6/1990 Buisseau ..... 53/564
5,061,231 A * 10/1991 Dietrich et al. ..... 493/317
5,411,464 A 5/1995 Calvert et al.
5,507,128 A * 4/1996 Johnson et al. ..... 271/277
5,536,231 A 7/1996 Nilsson
5,542,816 A * 8/1996 Wallin ..... 414/798.9
5,573,490 A * 11/1996 Steinbrenner et al. ..... 493/315
5,653,671 A * 8/1997 Reuteler ..... 53/564
5,813,965 A * 9/1998 Mitchell et al. ..... 493/315
5,928,123 A 7/1999 Davis, Jr.
5,997,458 A * 12/1999 Guttinger et al. ..... 493/315
6,050,063 A 4/2000 Ford et al.
6,168,149 B1 * 1/2001 Boldrini ..... 493/315
6,383,123 B1 5/2002 Ehring et al.
6,913,568 B2 7/2005 Frank et al.
2003/0168502 A1 9/2003 Kisch

* cited by examiner

*Primary Examiner*—Louis Huynh
(74) *Attorney, Agent, or Firm*—Richard A. Ryan

(57) ABSTRACT

The feed apparatus for feeding container blanks into a container forming machine comprises a hopper at or near its first end for holding a plurality of blanks, a selecting mechanism for selecting one of the blanks, a moving mechanism to move the blanks toward the elevated second end and then the machine and a transferring mechanism for rotating the blank from its angled direction to a substantially vertical direction for placement at the machine's receiving station. Preferably, the moving mechanism comprises a pair of parallel chains interconnected by a shaft having a gripping mechanism configured to securely grip the blank. A pivot mechanism pivots the shaft and the gripping mechanism, which is selectively opened to grip the blank below the hopper and release the blank at the machine. Laminating, folding and compressing components are provided to add adhesive, fold and then compress sections of the blank before reaching the machine.

27 Claims, 16 Drawing Sheets

FEED APPARATUS AND METHOD FOR FEEDING BLANKS INTO CONTAINER FORMING MACHINES

CROSS-REFERENCE TO RELATED APPLICATIONS

This application claims the benefit of U.S. Provisional Patent Application No. 60/718,060 filed on Sep. 16, 2005 and U.S. Provisional Patent No. 60/756,885 filed on Jan. 5, 2006.

BACKGROUND OF THE INVENTION

A. Field of the Invention

The present invention relates generally to container forming machines that are utilized to form containers out of flattened blanks so that they may be filled with product. More specifically, the present invention relates to apparatuses and methods for transferring the flattened blanks from a hopper having a plurality of such blanks to the receiving station of a container forming machine. Even more specifically, the present invention relates to such feed apparatuses and methods that are utilized to feed flattened container blanks to a container forming machine from a hopper having an ergonomically-friendly feed position at or near ground level for the machine operator.

B. Background

There is an ever-increasing need for improved containers to hold commodities of various sizes, shapes and dimensions. As new products and packaging are developed, there is a need for new container designs, as well as machinery to manufacture or form the particular containers. In the packaging industry, many different designs of fiberboard containers have been developed over the years. The term "container" is used interchangeably in the industry with "box," "case" and "package" to refer to a generally rectangular-shaped box-like object that is typically made out of a corrugated paperboard and configured to hold one or more products, including cartons, bottles, cans, meat or produce, therein. The container materials may be single face corrugated, single wall (double-faced) corrugated, double wall corrugated, triple wall corrugated and the like. Containers may also be made of other paperboard products including, without limitation, containerboard, boxboard, linerboard, and cardboard.

Modern product packaging systems are preferably configured to automatically and rapidly place products into containers with very little human interaction between the product and the container. The finished product is conveyed or otherwise delivered to a container conveyor system that conveys open containers to the location where the product is inserted into the container. Typically, the container and product is then further conveyed for insertion of other materials, such as written materials or packaging materials, and then the container is closed for delivery to its intended destination. For efficient container shipping and handling purposes, containers for the product packaging system are generally provided in a flat, folded condition. A plurality of the flat containers are placed in a hopper or magazine that is positioned near the beginning of the product packaging system. As a result, the first step in most product packaging systems is to retrieve one of the plurality of flat containers from the container hopper. The next step is to erect the container, typically utilizing an automated container forming machine, so as to place it in an open condition. The erected container is then conveyed to a position for insertion of the product.

Special box or container forming machines have been developed over the years to form different styles of boxes and cases. Such machines are generally configured in a vertical or horizontal arrangement, each with their own unique features and benefits. One of the primary benefits of vertically configured container forming machines is that they require significantly less floor space than horizontally configured machines. The primary disadvantage of the vertically configured machine is that the vertical arrangement of components results in the hopper being located well off of the floor.

A number of different container blank feeding systems and methods have been developed to move the blank into a position whereby it can be folded or formed to complete a process which results in a completed container. In most cases this operation is carried out by pushing the blank forward by means of a pusher bar or dog attached to either a chain or reciprocating mechanism. Some forming machines combine feed rollers with the reciprocating mechanisms whereby the blank is pushed forward into the nip of a pair or series of rollers, which in turn propel the blank forward into the folding position. These methods generally have one disadvantage in common, this being that the blank that is being fed reaches a stage where it is free falling as it passes in front of the forming tool or mandrel, as is the case with vertical forming machines, or carried by momentum during the final path of travel before coming to rest against a fixed stop, in the case of horizontal machines. This uncontrolled movement of the blank is generally inconsistent and, therefore, problematic as it can result in the blank not being correctly positioned prior to formation into the container. Unless additional mechanisms are fitted to the forming machines to prevent the uncontrolled travel of the blank, mis-formation of the box can occur resulting in box rejection and loss thereof. These additional mechanisms often cause an additional snag point that can interrupt the container's path of travel.

As stated above, a problem that is primarily particular to container forming machines which are disposed in a vertical configuration, as opposed to being arranged in a horizontal configuration, is that the blank hopper must be located above the receiving position of the container forming machine. As a result, the input to the hopper is located somewhat above the floor level, requiring a worker to place the blanks in the hopper using stairs, platforms or other types of devices to get above the hopper, which is well known to be very non-ergonomic. This problem is made worse by the relatively recent introduction of equipment to laminate and fold the blanks in the vertical plane prior to reaching the receiving position of the container forming machine, which further increases the height of the machine and the hopper. This makes the vertical container forming machine, in particular, very cumbersome and un-ergonomic for the worker. Even horizontal machines, which generally allow placement of blanks into the hopper to be performed at a lower level, are not always configured to allow the worker to stand on the floor and place blanks into the hopper at an ergonomically ideal level (i.e., for most people this is at waist level).

Apparatuses for retrieving and then erecting flat, folded container blanks from a hopper, magazine or other storage location are well known in the prior art. One type of apparatus has a rotary transfer mechanism, as exemplified by U.S. Pat. No. 4,881,934 to Harston, et al., U.S. Pat. No. 4,537,587 to Langen and U.S. Pat. No. 5,997,458 to Guttinger, et al., that retrieves, erects and then conveys away the container. U.S. Pat. No. 5,813,965 to Mitchell, et al. discloses a machine for transferring and erecting cardboard package blanks that has a vacuum head rotatably mounted on the end of an elongated arm that pivots up and down about a fixed pivot to pick a flat blank from an above-disposed hopper and place the erected blank on a conveyor. U.S. Pat. No. 5,573,490 to Steinbrenner, et al. and U.S. Pat. No. 5,061,231 to Dietrich, et al. disclose a method and apparatus for erecting a folding box that has a transfer device comprising a three-armed rotor having suction holders at the ends thereof that withdraws the box blanks from an above-disposed magazine. U.S. Pat. No. 6,168,149 to Boldrini discloses a method and unit for feeding blanks to a machine wherein two pickup heads withdraw blanks, by suction to a flat surface of the head, from their respective above-disposed hoppers and feed them into conveying pockets on a conveyor system. U.S. Pat. No. 6,383,123 to Ehring, et al. discloses an apparatus for transferring flat boxes that comprises an above-disposed hopper from which a single box is obtained by a plurality of suction systems with suction heads that are each coupled to separate drive mechanisms that revolve the suction heads about a closed path. In contrast to the above, U.S. Pat. No. 5,653,671 to Reuteler discloses a carton feeder assembly that has the supply magazine substantially at the conveyor level so the operator can readily stack flat cartons onto the carton supply conveyer. The carton selector portion of the machine includes a pair of feeder wheels with suction devices that move along a linear pick line as the wheels rotate to apply suction to the selected carton. None of the foregoing and nothing known in the prior art discloses a feed apparatus and method effectively and efficiently feeds container blanks into vertically configured container forming machine that does not require the operator to place the blanks into a hopper positioned above the receiving station of the container forming machine.

What is needed, therefore, is a new feed apparatus and method for feeding container blanks into the receiving station of a container feeding machine that allows the operator to place the blanks into a hopper at a more ergonomically comfortable level, such as at or near the worker's waist level. The preferred feed apparatus and method should interact with the hopper at or near waist level to retrieve and deliver one container blank at a time to the receiving station of the forming machine that will open or unfold the container. The preferred feed apparatus and method should be configured for controlled delivery of the blank to the container forming machine so as to not allow the blank to free fall or move freely along its path. The preferred feed apparatus and method should be configured to use laminating and folding components to laminate and fold the blank prior to it reaching the receiving station of the container forming machine. The preferred feed apparatus and method should also be adaptable for use with a wide variety of container forming machines, including vertically and horizontally arranged container forming machines.

SUMMARY OF THE INVENTION

The feed apparatus and method for feeding blanks into container forming machines of the present invention provides the benefits and solves the problems identified above. That is to say, the present invention discloses a feed apparatus and method that is configured to feed a container blank from a hopper having a plurality of such blanks to a receiving station of the container forming machine in a manner that allows the hopper input to be located at a more ergonomic level for the worker, particularly for vertically configured container forming machines. The feed apparatus and method of the present invention is configured to deliver a container blank from the hopper to the receiving station in a controlled manner so as to prevent the blank from free falling or otherwise moving freely along its path to accurately place the blank at the receiving station. The feed apparatus and method of the present invention is adaptable for incorporating laminating and folding components to laminate and fold a portion of the blank prior to reaching the container forming machine receiving station. The feed apparatus and method of the present invention is also adaptable to a wide variety of container forming machines, including both vertically and horizontally arranged machines.

The preferred embodiment of the container blank feed apparatus of the present invention overcomes the drawbacks of existing apparatuses and methods of feeding blanks into vertical and horizontal container forming machines by gripping the trailing edge of a pre-positioned container blank with mechanical, pneumatic or electrical activated grippers that are attached to a pair of continuous chains which follow a predetermined path to the forming stage or forming position of the container forming machine. The preferred gripper mechanism takes hold of the trailing edge of the container blank and pushes it forward along a track feed path that is defined by the path of the parallel pair of chains driven by a plurality of sprockets. The gripper mechanism is attached to a pivoting shaft that attaches to the pair of guided chains by means of a specially configured link at its ends. The path of the chains is tracked outside of the extremities of the maximum width of the widest mandrel or forming tool that is envisaged for the particular container forming machine. This allows the gripping mechanism to pass freely under or in front of the mandrel or forming tool depending on the particular machine in question. Once the blank is in the required position, the grip on the container blank is released and the forming tool or mandrel is then activated to complete the container forming process.

The present invention also overcomes the inconsistent feed that can result on conventional machines where the container blank is driven between a pair of pre-set guides. Often, container blank size variation and inconsistency, which is common in die-cut corrugated container blanks, creates snagging and the velocity of the container blank is affected, resulting in speed fluctuations and misalignment of the blank relative to the forming position. This problem is overcome in the present invention by the gripper securely taking hold of the bank, thereby eliminating the need for additional guiding. Generally, when small blanks are being run higher speeds are required, resulting in the reciprocating feed methods become more and more inefficient. By attaching a number of gripper units to the track feed at the required spacing for the size of blank being fed into the container forming machine, the track feed apparatus of the present invention deliverers blanks in a continuous, controlled manner.

The track feed apparatus of the preferred embodiment of the present invention includes the following basic elements: (a) a series of spaced apart sprockets positioned in strategic positions relative to the path of travel required for the container blank to follow; (b) a pair of chains that are driven by the sprockets; (c) pivoting shafts that span the gap between the pair of chains and are attached to the chains by means of a specialized linkage; (d) a gripper mechanism that is cam operated to grip or release the container blank and is attached to the pivoting shaft; (e) cam profiles that activate and release the gripper mechanism; and (f) a cam mechanism for re-orientation of the gripper head prior to reaching the "pick" position where a container blank is obtained from a hopper having a plurality of container blanks.

The preferred embodiment of the present invention, also includes the ability to laminate, fold and compress a portion of the container blank, typically the portion that becomes the sides of the container, prior to where the container blank is directed into the receiving station of the container forming machine. A laminating section has a dispensing mechanism, typically one or more applicator heads, for dispensing an adhesive material on one section of the container blank. A folding section has a folding mechanism, typically a pair of folding rails, that direct another section of the container blank onto the adhesive. A compression section has one or more compression rollers that compresses the two sections together to obtain the adhesive bond.

In an alternative embodiment of the present invention, the feed apparatus comprises a plurality of pusher blocks attached to the chains that are configured to engage the trailing edge of the container blank and push it from the selecting mechanism at the apparatus's first end towards its second end. As with the preferred embodiment, the feed apparatus can be configured to laminate, fold and compress sections of the container blank. In a preferred configuration of this embodiment, the compression is obtained by feeding the container blank through a pair of opposing rollers that are configured with conveyor belts to convey the container blank to the transfer section of the feed apparatus. Also in the preferred configuration of this embodiment, the transfer section has a transfer module that comprises a pair of oscillation guides that receive the container blank thereon and which are oscillated and pivoted downward to place the container blank in the desired position to be received by the receiving station of the container forming machine.

Accordingly, the primary objective of the present invention is to provide an improved feed apparatus and method for feeding container blanks into container forming machines that provides the advantages discussed above and overcomes the disadvantages and limitations associated with presently available container blank feed apparatuses and methods.

It is also an important objective of the present invention to provide a container blank feed apparatus and method that is configured to feed blanks into a container forming machine from a hopper having its input at an ergonomically comfortable level.

Another important objective of the present invention is to provide a container blank feed apparatus and method having a hopper component with its input at an ergonomically comfortable level that is configured to feed a container blank into the receiving station of container forming machines, particularly such machines that are vertically arranged.

Yet another important objective of the present invention is to provide a container blank feed apparatus and method that is configured to controllably deliver a container blank from a hopper having a plurality of such blanks to the receiving station of a container forming machine in a manner that prevents free falling or free movement of the blank so as to provide accurate and controlled positioning of the container blank for forming and folding by a mandrel or similar mechanism.

Yet another important objective of the present invention is to provide a container blank feed apparatus and method that includes laminating, folding and compressing components in the feed apparatus that are configured to laminate, fold and compress a portion of the container blank before it arrives at the receiving station of a container forming machine.

A further objective of the present invention is to provide a container blank feed apparatus and method that is adaptable to a wide variety of different container forming machines, including both vertically and horizontally configured machines, so as to feed container blanks on horizontal, vertical or angular planes or a combination of planes.

It is a further important object of the present invention, to provide a container blank feed apparatus and method that can feed container blanks continuously, whereby the only limitation to speed is the cyclical nature of the container forming mechanism.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the feed apparatus and method of the present invention, the preferred embodiments of the present invention are set forth below. As will be recognized by those skilled in the art, the enclosed figures and drawings are merely illustrative of a preferred embodiment and represents one of several different ways of configuring the present invention. Although specific components, materials, configurations and uses are illustrated, it should be understood that a number of variations to the components and to the configuration of those components described herein and in the accompanying figures can be made without changing the scope and function of the invention set forth herein.

Figure 1:
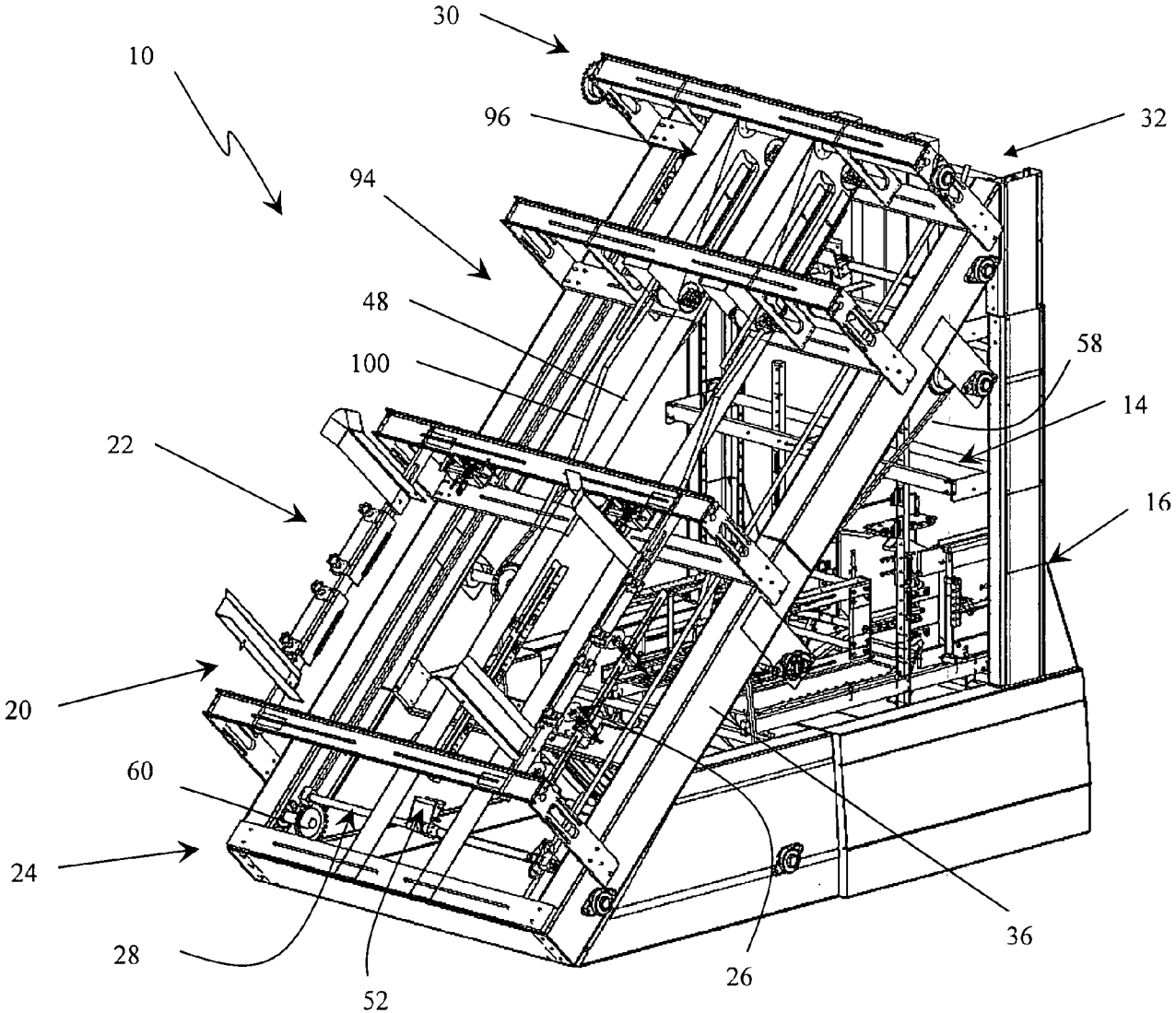
FIG. 1 is a front perspective view of a container blank feed apparatus configured according to a preferred embodiment of the present invention shown attached to the receiving station portion of a container forming machine.
Figure 2:
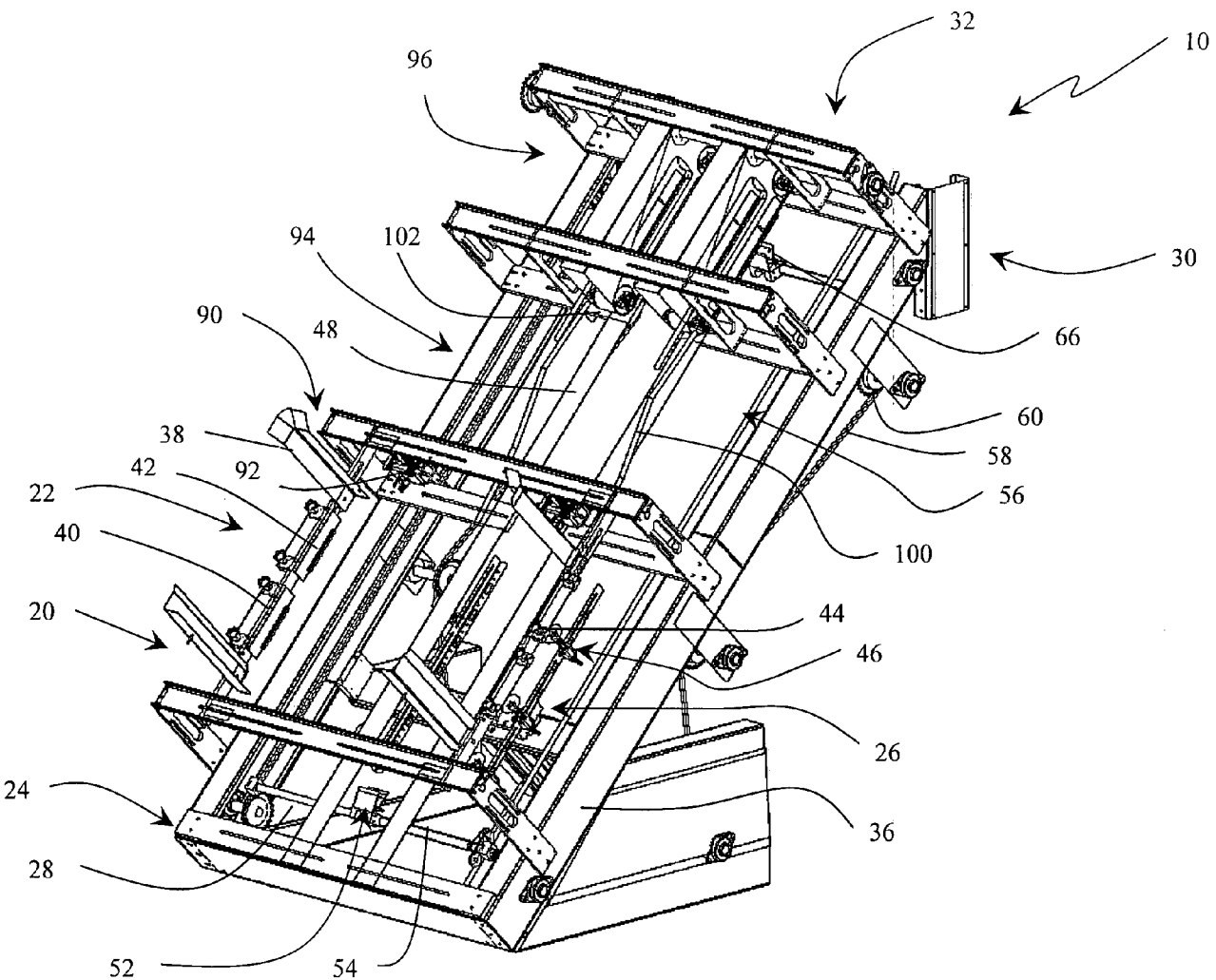
FIG. 2 is a front perspective view of the container blank feed apparatus of FIG. 1.
Figure 3:
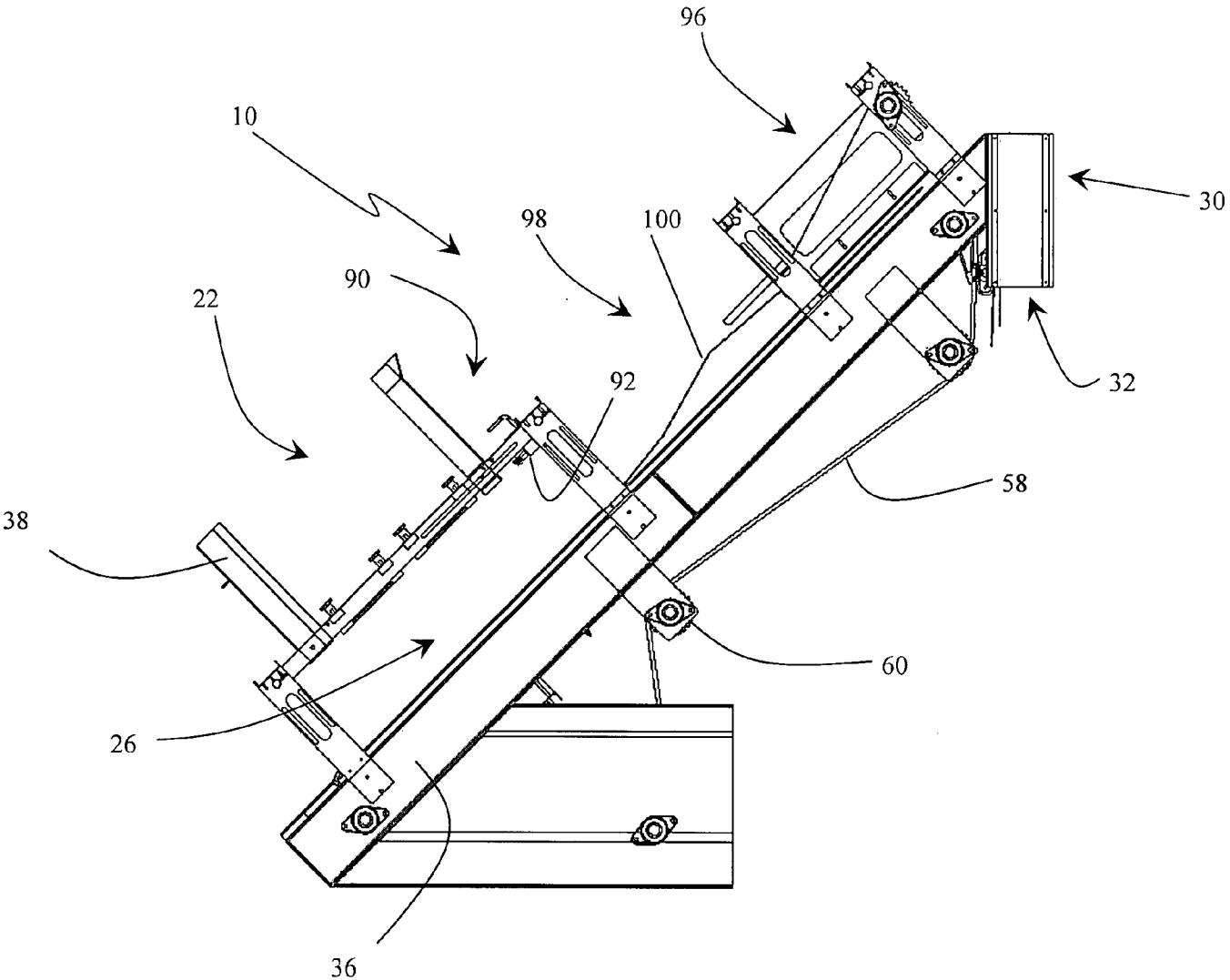
FIG. 3 is a side view of the container blank feed apparatus of FIG. 2.
Figure 5:
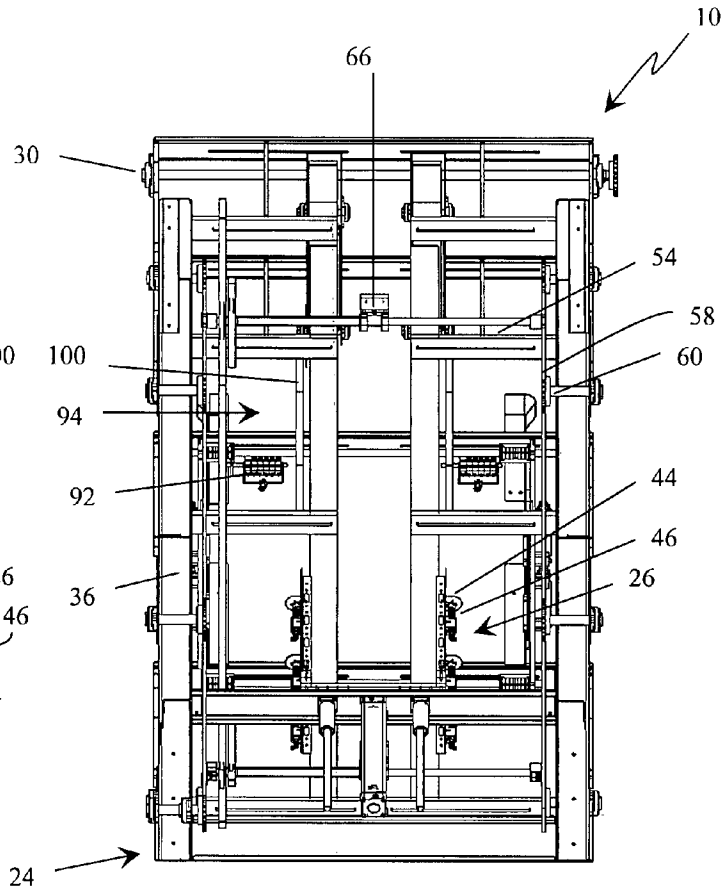
FIG. 5 is a back view of the container feed apparatus of FIG. 2.
Figure 4:
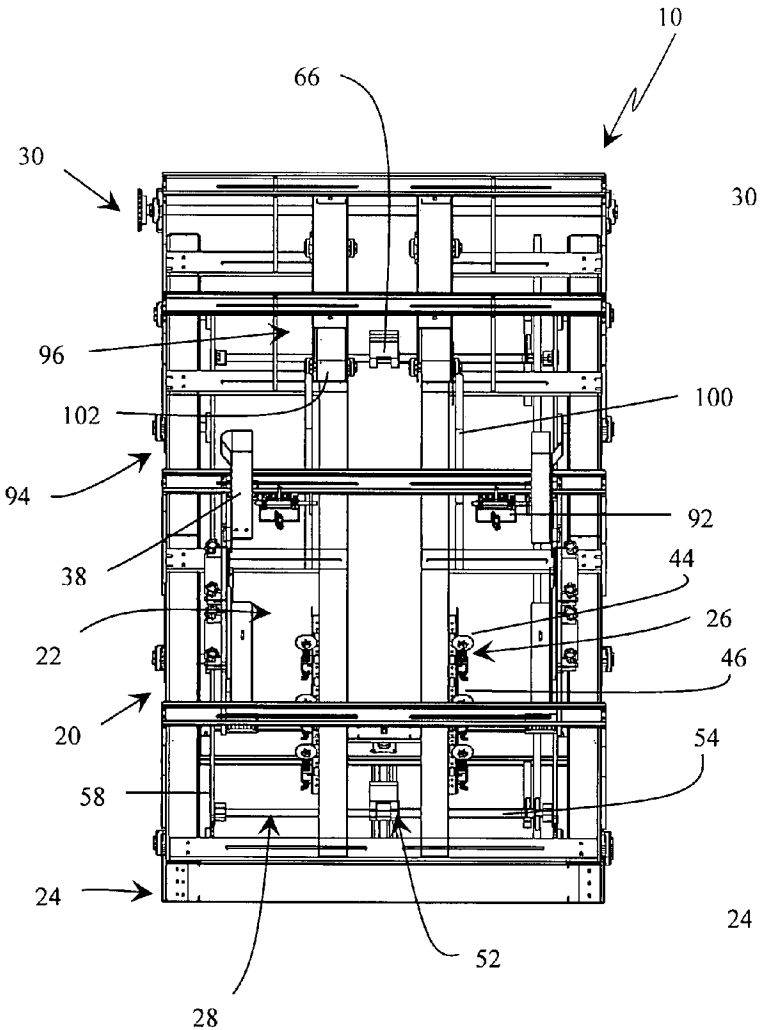
FIG. 4 is a front view of the container feed apparatus of FIG. 2.
Figure 6:
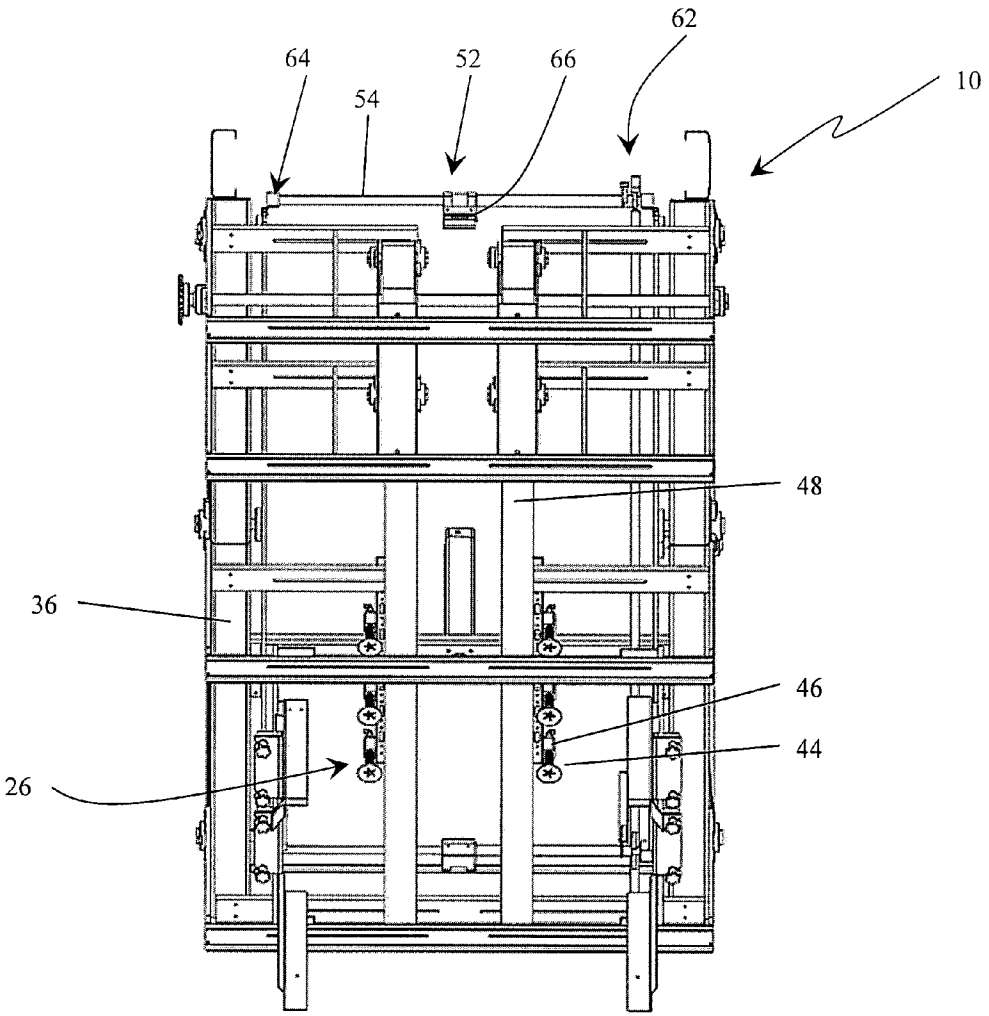
FIG. 6 is a top view of the container feed apparatus of FIG. 2.
Figure 7:
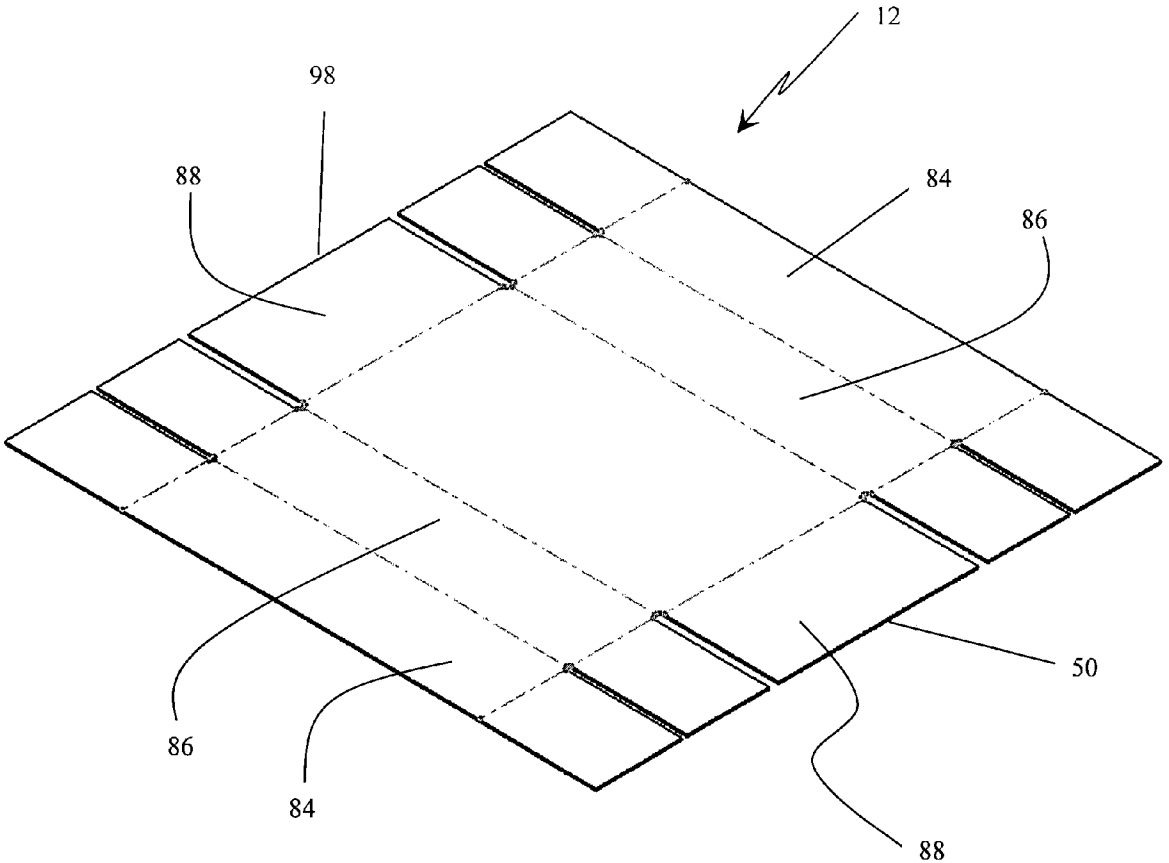
FIG. 7 is a top perspective view of an exemplary container blank for use with the container feed apparatus of the present invention, with the phantom lines representing score or crease lines.
Figure 9:
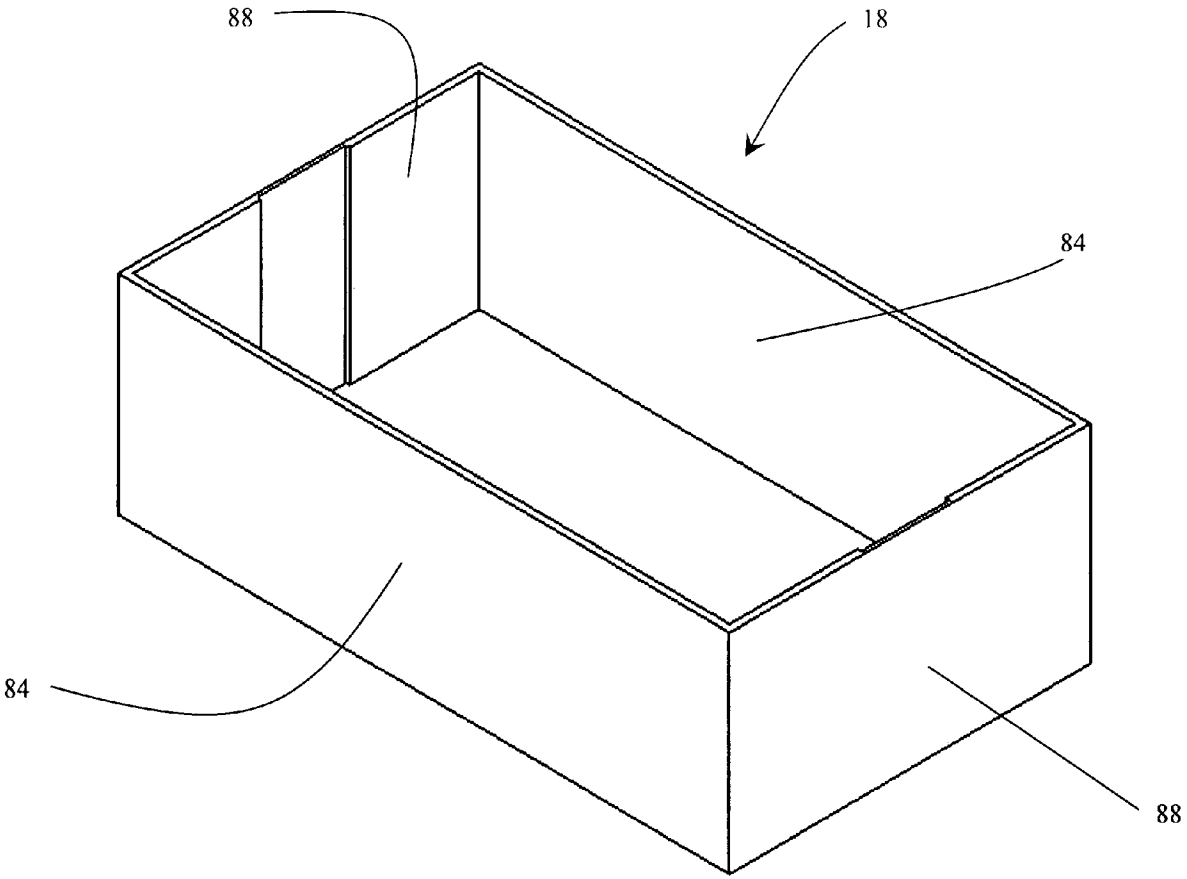
FIG. 9 is a top perspective view of a fully formed container as formed by a container forming machine having laminated sides.
Figure 10:
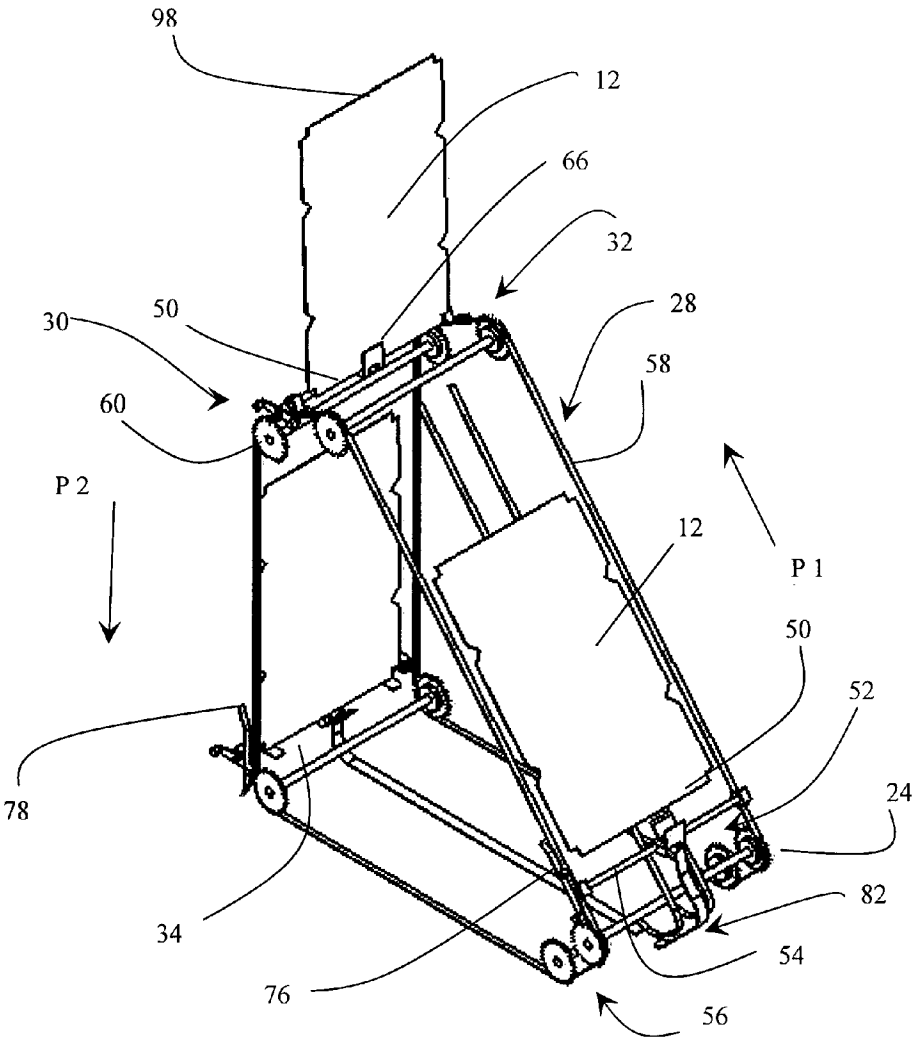
FIG. 10 is a side perspective view of an alternative configuration of the internal track feed components of a container blank apparatus shown with container blanks in various positions along the track feed path.

A container feed apparatus that is manufactured out of the materials and pursuant to a preferred embodiment of the present invention is shown generally as 10 in FIGS. 1-6. Feed apparatus 10 is configured to deliver a container blank 12, best shown in FIGS. 7 and 10, to the receiving station 14 of a container forming machine 16, only a portion of which is shown in FIG. 1, where the container blank 12 will be formed into container 18, shown in FIG. 9. Feed apparatus 10 of the present invention generally comprises a receiving section 20 with a hopper 22 generally at or near the first end 24 of feed apparatus 10, which in the configuration shown is the lower end, for receiving a plurality of container blanks 12 therein, a selecting mechanism 26 for selecting a single blank 12 from the hopper 22, a moving mechanism 28 to move the selected blank 12 upward, in the configuration shown, from the receiving section 20 toward the second or upper end 30 and a transfer section 32, generally at or past second end 30, with a transfer mechanism 34 to transfer the blank 12 to the desired position for receiving station 14 of container forming machine 16. The various components of feed apparatus 10 are supported by frame 36, which is configured to operatively attach to or abut container forming machine 16. For use with vertically arranged container forming machines 16, frame 36 is configured to support feed apparatus 10 at an upwardly directed angle from first end 24 to second end 30. In the embodiment of FIG. 1, transfer mechanism 34 is the configuration of the second end 30 that transfers the container blank 12 from its angular path to the generally vertical path desired for use by the receiving station 14 of container forming machine 16, as best shown in FIG. 10. The configuration of feed apparatus 10 shown in FIGS. 1-6 is particularly beneficially configured for use as a retrofit arrangement to attach to an existing vertical feed container forming machine 16 at transfer section 20 that transfers blank 12 to the feed rollers, an example of which is shown as 124 in the alternative embodiment of FIG. 16, of the receiving station 14 of machine 16. Feed apparatus 10 essentially hands-off the blank 12 by placing it at the entrance to the machines'feed rollers. As understood by those skilled in the art, the exact positioning of the transfer to the container forming machine 16 will depend on the configuration of the particular machine 16 (i.e., it may take place higher or lower than that shown in the figures). The embodiment of the internal track feed components shown in FIG. 10 illustrates a configuration that is particularly useful for a new, improved container forming machine 16 or an existing machine 16 that does not utilize feed rollers. Instead, the blank 12 at transfer section 32 is transferred directly to the machine 16 for forming into container 18.

Figure 16:
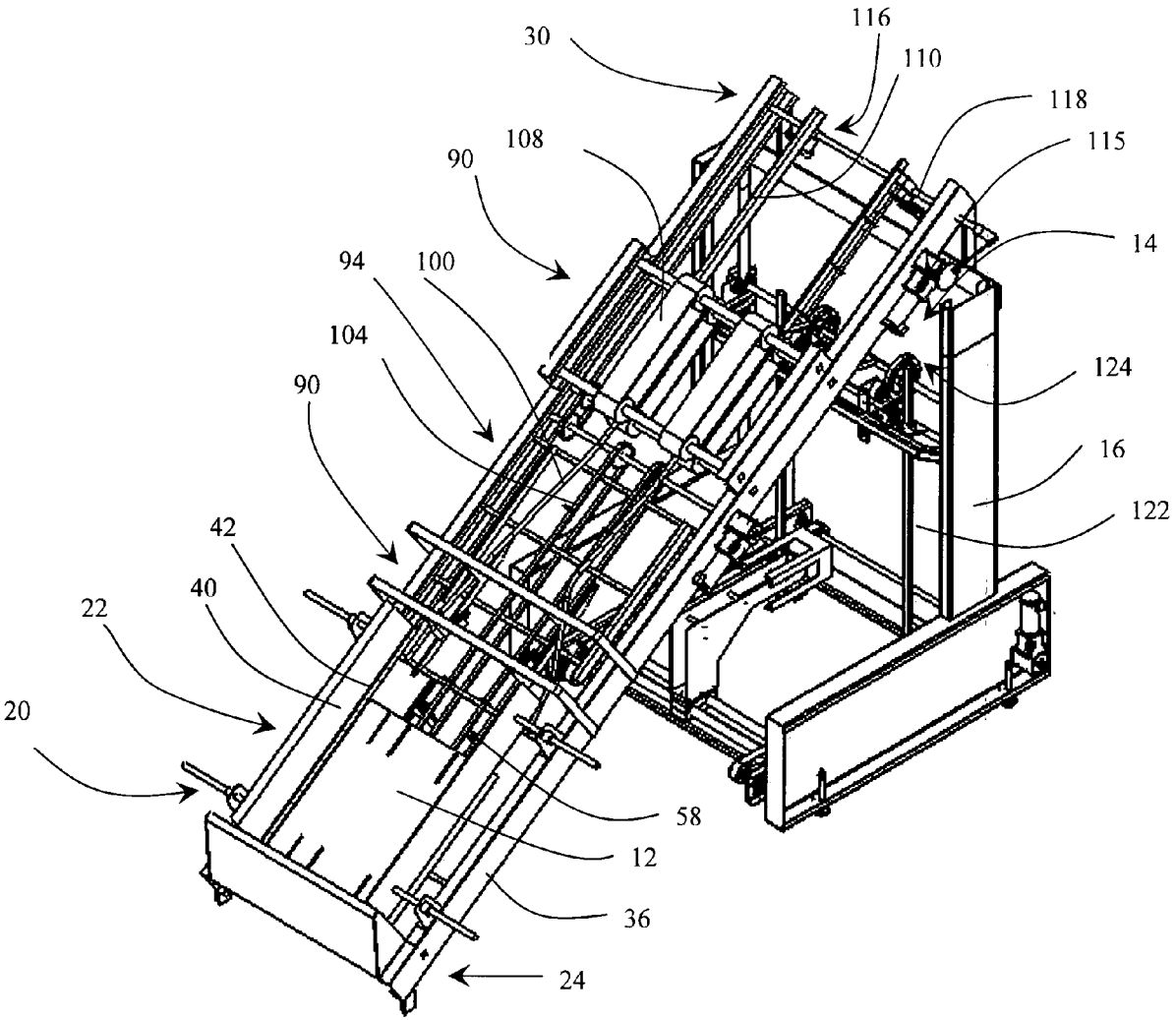
FIG. 16 is a front perspective view of a container blank feed apparatus configured according to an alternative embodiment of the present invention shown with a container blank in the hopper thereof.

As known to those skilled in the art, hopper 22 is configured to receive and hold a plurality of container blanks 12 for forming into containers 18. In the configuration shown in FIGS. 1-6, hopper 22 is defined by a plurality of hopper posts 38 that are spaced apart and configured so as to engage the corners of container blank 12. The bottom of hopper 22 is configured such that substantially the majority of the body of container blank 12 is available for contact with selecting mechanism 26, with two or more of opposing outer edges thereof supported by frame members 40 having inwardly extending ledges 42, to allow the selecting mechanism 26 to pull one container blank 12 through receiving section 20 from the bottom thereof. The embodiment shown in FIG. 16 illustrates a different configuration for hopper 22 that utilizes a pair of elongated frame members 40 having inwardly extending ledges 42 thereon that support the outside edges of container blank 12. As will be readily apparent to those skilled in the art, a variety of different configurations are possible for hopper 22. To function herein, hopper 22 should be suitable for receiving and holding a plurality of container blanks 12 in a position at or near first end 24 of feed apparatus 10. Preferably, hopper 22 should be adjustable in size for different sizes of container blanks 12 and positioned at an ergonomically comfortable level relative to the worker so that he or she does not have to get into an uncomfortable position to place container blanks 12 into hopper 22. Typically, this will place the opening into hopper 12 at or near the average worker's waist so as to eliminate excessive bending or reaching. This is particularly important when feed apparatus 10 is configured for use with vertically arranged container forming machines 16, as shown in the figures, so the worker does not have to place container blanks 12 into a hopper disposed above the machine 16, as is done in the prior art.

As stated above, with a plurality of container blanks 12 in hopper 12 the selecting mechanism 26 operates to select one of the container blanks 12. In the preferred embodiment, the selecting mechanism 26 is a vacuum feeder that comprises one or more suction cups 44 operatively attached to pneumatic cylinders 46 which, on activation, extend the suction cups 44 to make contact with the lower side of the selected container blank 12. The function and use of pneumatically powered suction cups 44 to securely contact a container blank 12 is well known by those skilled in the art. With a vacuum applied to container blank 12, the pneumatic cylinders 46 retract to pull suction cups 44 and the attached container blank 12 downward through the bottom of hopper 22 to remove the selected container blank 12 from the plurality of container blanks 12 in hopper 22. In the embodiment of FIG. 1, the selecting mechanism 26 then deposits the container blank 12 on a pair of elongated guide members 48, which support the container blank 12 as it moves to the next stage of feed apparatus 10 via moving mechanism 28.

In the preferred embodiment of the feed apparatus 10 of the present invention, moving mechanism 28 is configured to engage the trailing edge 50 of container blank 12 and drive container blank 12 along a first feed path P1 toward second end 30, as best shown in FIG. 10. From second end 30, a second feed path P2 delivers container blank 12 to receiving station 14 of container forming machine 16. The preferred moving mechanism 28, shown in FIGS. 1-6 and 10-15, comprises gripping mechanism 52 fixedly attached to shaft 54 that is driven along first P1 and second P2 feed paths by drive mechanism 56, which in the preferred embodiment is a continuous chain drive system having a parallel pair of elongated drive members, such as chains 58, and a plurality of sprockets 60 which drive the chains 58. Chains 58 are attached to or other wise engage specially configured (but "off-the-shelf") links at the first end 62 and second end 64 of shaft 54 so as to move shaft 54, with gripping mechanism 52 thereon, along first P1 and second P2 feed paths. The path of the chains 58 along second feed path P2 is tracked outside of the extremities of the maximum width of the widest mandrel or forming tool that is envisaged for the particular container forming machine 16. This configuration allows the gripping mechanism 52 to pass freely under or in front of the mandrel or forming tool depending on the particular machine 16 in use. As known to those skilled in the art, belts and pulleys, as well as other devices, may be utilized for drive mechanism 56 instead of the chains 58 and sprockets 60 shown in the figures.

Figure 11:
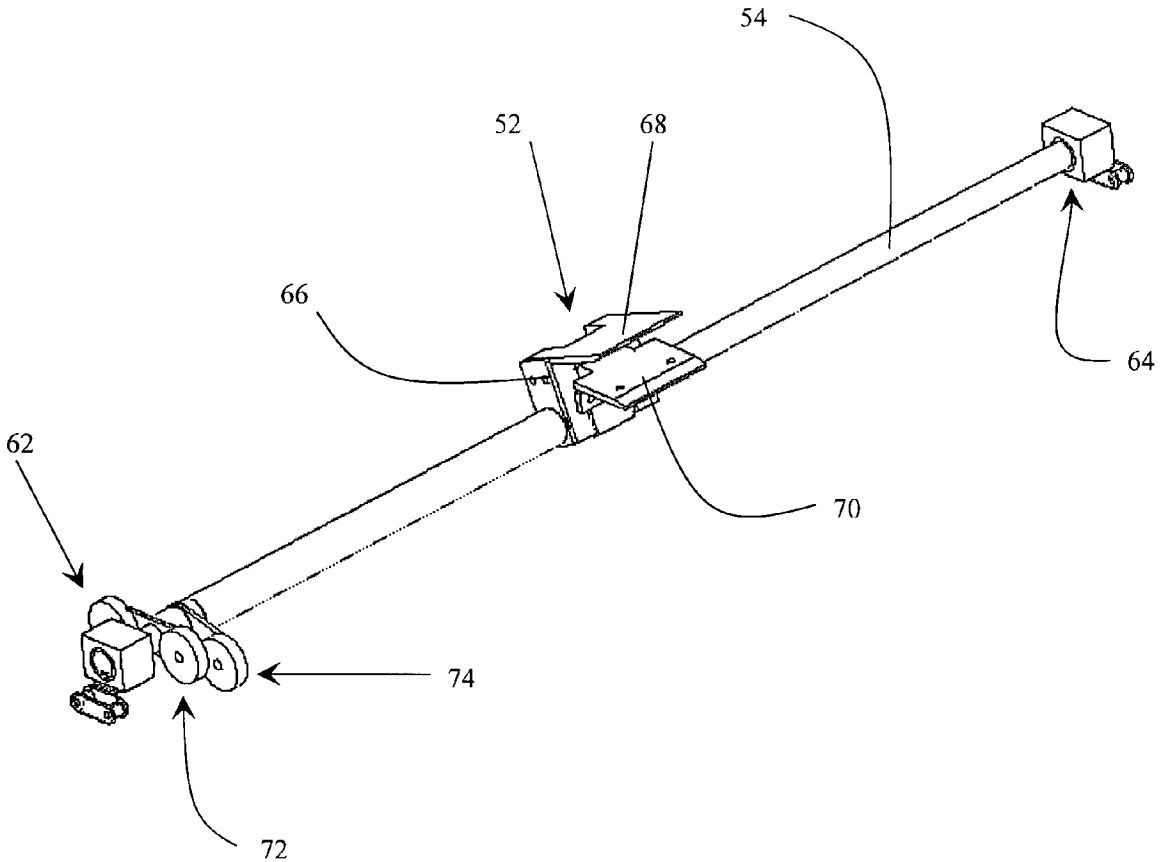
FIG. 11 is a side perspective view of a preferred embodiment of the gripper mechanism and shaft for use with the container blank feed apparatus of the present invention.
Figures 12, 13:
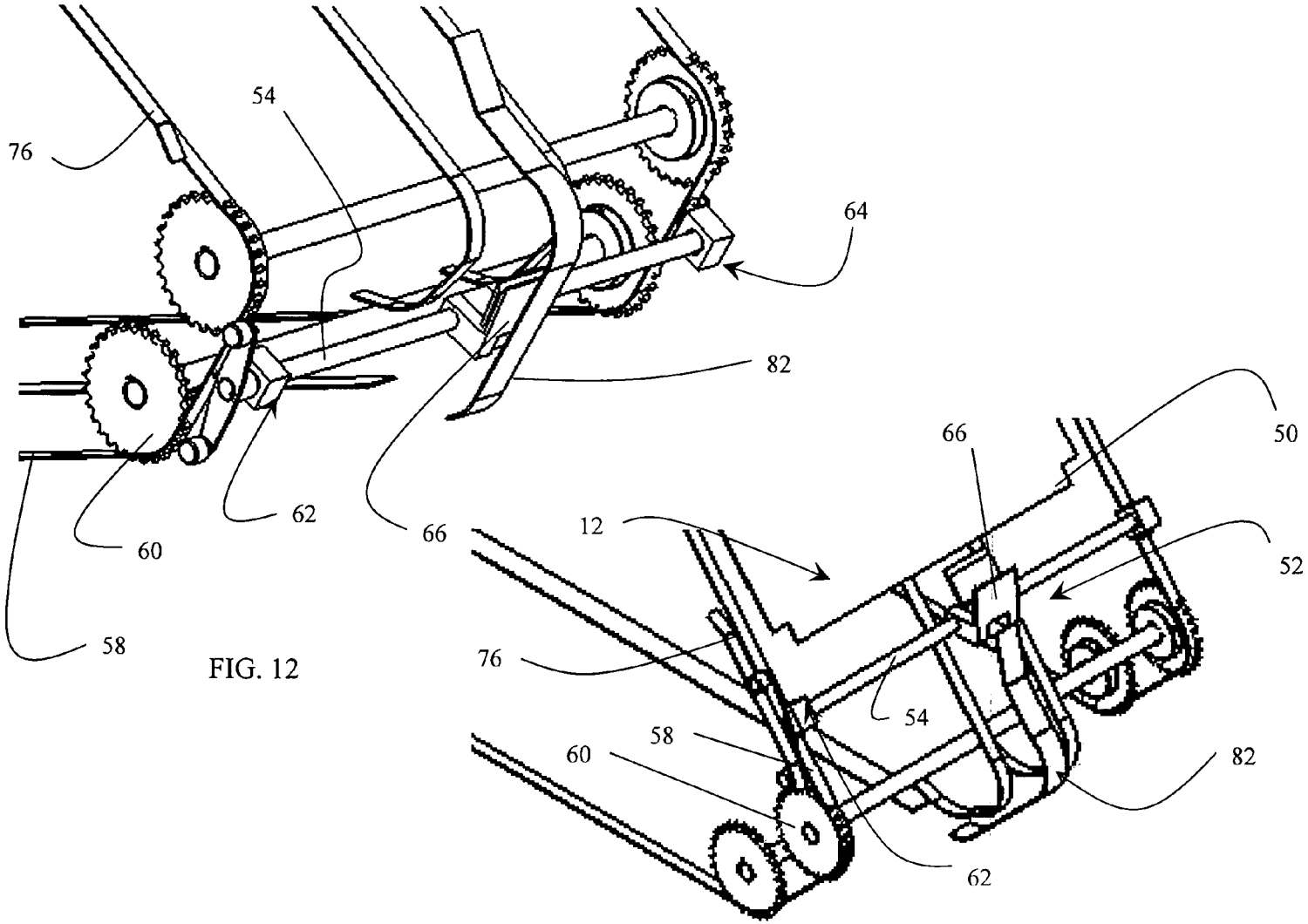
FIG. 12 is an isolated side perspective view of the lower portion of the track feed components of FIG. 10 showing the cam track reorientating the gripping mechanism to face it towards the trailing edge of the container blank.
FIG. 13 is an isolated side perspective view of the lower portion of the track feed components of FIG. 10 showing the gripping mechanism, which has been opened by a first cam plate, about to grip the trailing edge of a container blank.
Figure 14:
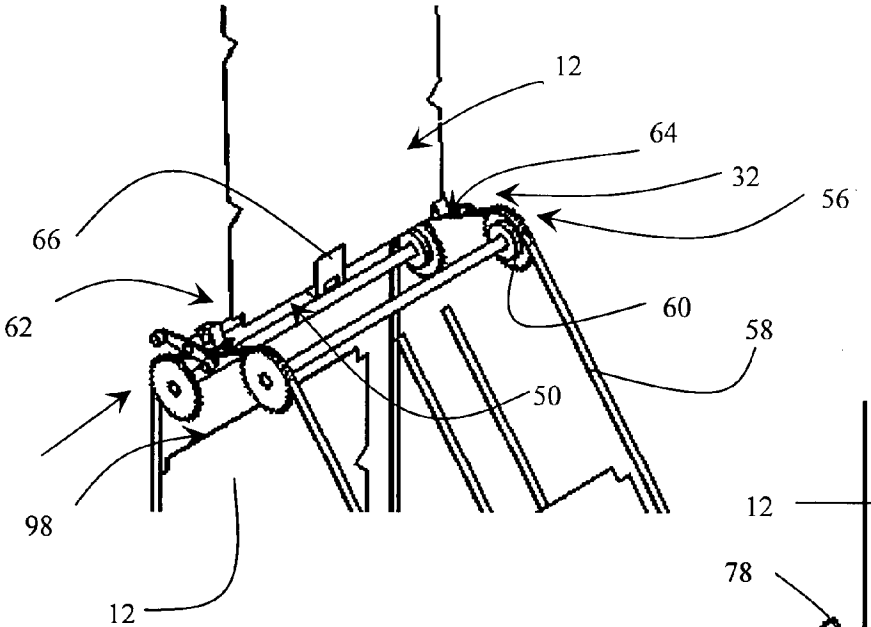
FIG. 14 is an isolated side perspective view of the upper portion of the track feed components of FIG. 10 showing the container blank being positioned for entry into the transfer section of the feed apparatus.
Figure 15:
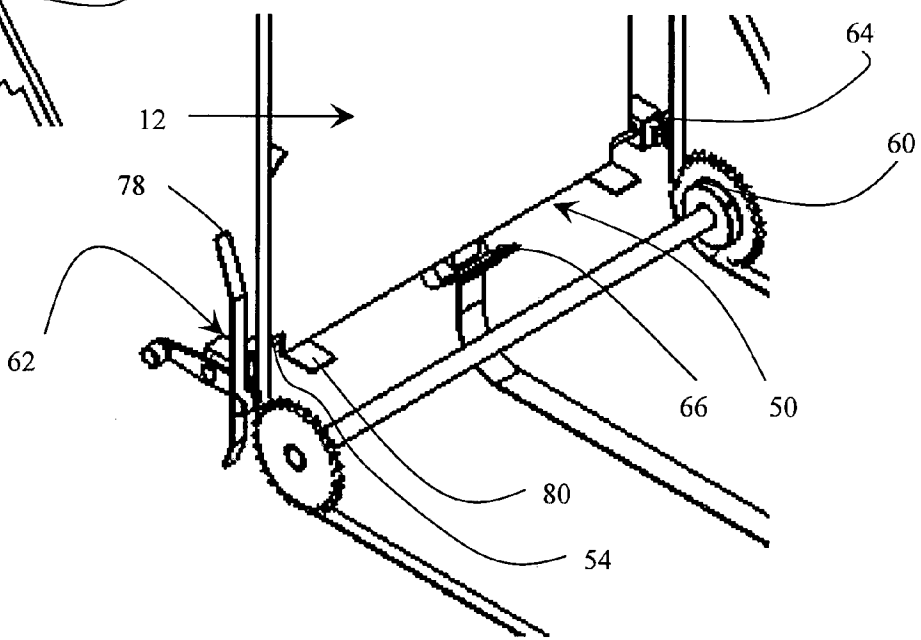
FIG. 15 is an isolated side perspective view of the lower back portion of the track feed components of FIG. 10 showing the gripping mechanism opening to allow the container blank, resting on a pair of stop members, to enter the receiving station of the container forming machine.

Gripping mechanism 52 can be mechanically, pneumatically or electrically (i.e., electronic opening/closing with wired or wireless signal) activated to selectively grasp the trailing edge 50 of container blank 12 to accomplish the objectives of the present invention. In a preferred embodiment, best shown in FIG. 11, gripping mechanism 52 is mechanically activated and comprises a gripper 66 made up of a first grip member 68 and a cooperatively configured spring-loaded second grip member 70, with the second grip member 70 being configured to be biased toward the first grip member 68 so as to maintain gripper 66 in a normally closed position. As described in more detail below, the spring-loaded gripper 66 is configured such that a portion of container blank 12, preferably its trailing edge 50, will be securely gripped between first 68 and second 70 grip members, as best shown at the second end 30 of feed apparatus 10 in FIGS. 10 and 13, so that container blank 12 can be moved along first P1 and second P2 feed paths. In the preferred embodiment, the first end 62 of shaft 54 has a pivoting mechanism 72 configured to pivot shaft 54, and gripping mechanism 52 therewith, at predetermined positions along the feed paths P1 and P2. In the preferred configuration, as shown in FIG. 11, second end 64 of shaft 54 is configured to allow shaft 54 to pivot in response to the operation of pivoting mechanism 72. As known to those skilled in the art, shaft 54 can be non-pivoting, with gripping mechanism 52 pivotally attached thereto, and pivot mechanism 72 can be configured to pivot gripping mechanism 52 relative to shaft 54.

Also attached to shaft 54 in the preferred embodiment of feed apparatus 10 is a gripper opening mechanism 74 configured to be cooperatively engaged by one or more cam mechanisms, such as first cam plate 76 near the first end 24 of feed apparatus 10 and second cam plate 78 at the location along second feed path P2 where container blank 12 is delivered to receiving station 14 of container forming machine 16, which in the configuration shown in FIG. 10 is at the bottom of transfer section 32, to open gripper 66 at the predetermined positions along first P1 and second P2 feed paths. In the preferred embodiment, first 76 and second 78 cam plates are configured to cooperate with gripper opening mechanism 74 to mechanically counteract the biasing force of the spring-loaded gripper 66 to separate second grip member 70 from first grip member 68, thereby opening gripper 66. At first cam plate 76, the purpose of opening gripper 66 is to receive the trailing edge 50 of container blank 12 into gripper 66 so that trailing edge 50 may be securely engaged therein by the closing of the spring-loaded gripper 66. In contrast, at second cam plate 78 the purpose of opening gripper 66 is to allow the container blank 12 to be removed from gripper 66 and placed in position for receiving station 14 of the container forming machine 16. In the embodiment of FIGS. 1-6, trailing edge 50, which becomes the leading edge relative to its motion into the container forming machine 16, is received into the feed rollers of the container forming machine 16. In the embodiment of FIG. 10, the transfer to the receiving station 14 is achieved by utilization of a stop member 80 that stops the movement of container blank 12 at the position where it is then fed into container forming machine 16. The feed apparatus 10 of the present invention also includes a cam track 82 that re-orientates gripper 66 so that the front of first 68 and second 70 grip members are in the forward or leading position and ready, when opened by first cam plate 76, to take hold of the next container blank 12 from hopper 22, thereby repeating the cycle.

In operation, a container blank 12 is positioned on guide members 48 by means of a selecting mechanism 26, preferably a vacuum feeder having suction cups 44 and pneumatic cylinders 46, that generally removes a container blank 12 from the hopper 22. In this position, the pre-positioned blank 12 lies on the same plane as the path of travel as the gripper 66 attached to shaft 54. The gripper 66 is driven forward by the chains 58 to which it is attached at its ends 62 and 64. The pre-opened gripper 66, opened by the interaction between the cam profile of first cam plate 76 and the gripper opening mechanism 74, is moved toward the trailing edge 50 of container blank 12 until the trailing edge 50 abuts the back of the open jaws of the gripper 66. As the chains 58 continue to drive gripper mechanism 52 forward, first cam plate 76 sets the gripper mechanism 52 to the grip position, thus firmly securing the container blank 12 in gripper 66. The drive mechanism 56 moves container blank 12 to the transfer mechanism 34 at second end 30 where container blank 12 is pivoted from the angled direction of travel in to a vertical direction as it moves from first feed path P1 to second feed path P2. At this point, the trailing edge 50, as defined at point of feed, becomes the leading edge as the container blank 12 transfers from the angular plane to the vertical plane for feeding into the feed rollers of the container forming machine 16. The chains 58 continue to move the gripped blank 12 forward into the predetermined position, at which point the profile of second cam plate 78 re-sets the gripper 66 to the open or release position. In the embodiment of FIG. 1, the container blank is then fed into the feed rollers of a vertical container forming machine 16 on an angular plane whereby. In the embodiment of FIG. 10, the container blank 12 is left in position resting against the fixed stop members 80. After releasing the container blank 12, the chains 58 continue driving the released gripper 66 forward while the mandrel or forming tool of the container forming machine 16 completes the container forming process. A set of cam tracks 82 re-orient the front of the gripper 66 to ensure that the grip members 68 and 70 are in the correct position to pick the next container blank 12. The gripper 66 once again takes hold of the next pre-positioned container blank 12, thereby continuing the process of picking and placing container blanks 12, in a continuous manner, in the receiving station 14 of container forming machine 16 to form containers 18 or the like.

Figure 8:
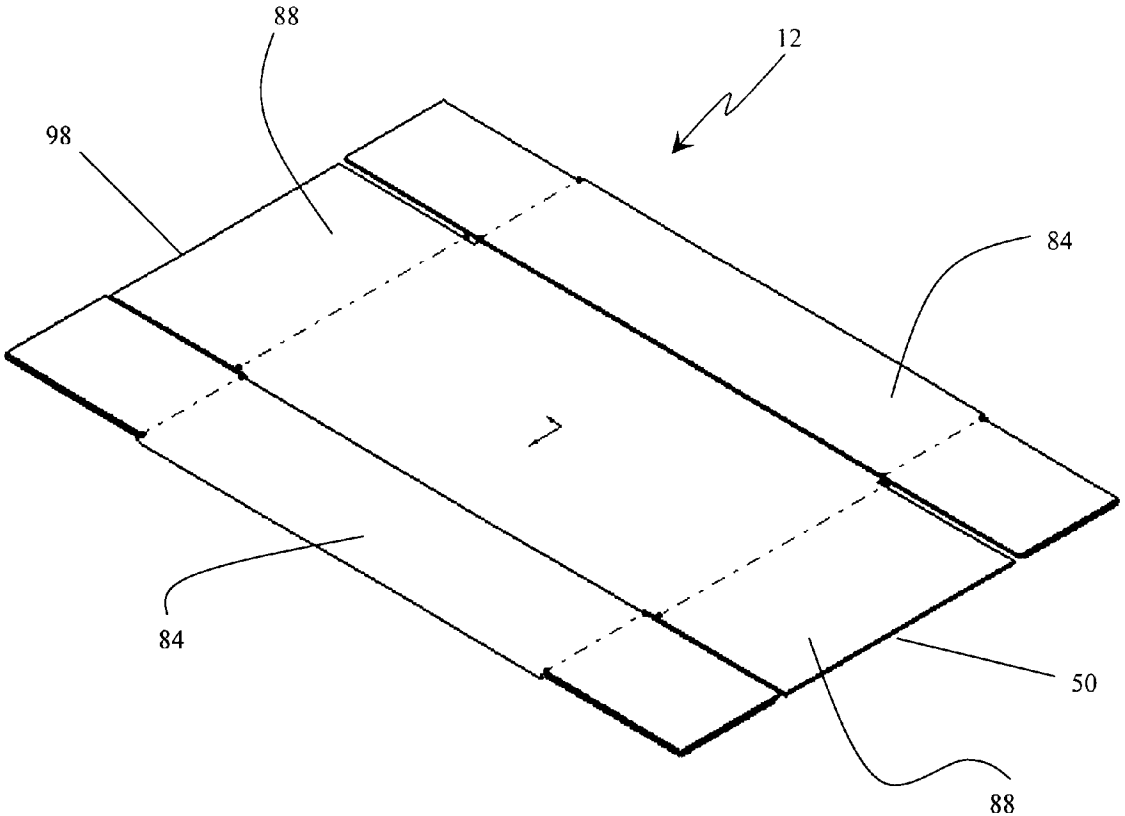
FIG. 8 is a top perspective view of the container blank of FIG. 7 with the outer side sections folded over and laminated.

In the preferred embodiment of the present invention, feed apparatus 10 also laminates, folds and compresses portions of container blank 12. As shown on FIG. 7, container blank 12 has first side sections 84 that are folded over on and adhered to second side sections 86, as shown in FIG. 8, to form the sides of container 18, shown in FIG. 9, with ends 88. Glue or other adhesive material is placed on second side sections 86 and then first side sections 84 are folded on top of the glue and compressed to obtain the desired bonding. Many in the industry would prefer that this initial laminating and folding would be done prior to the container blank 12 reaching the receiving station 14. The preferred embodiment of the present invention accomplishes this objective. As shown in the embodiment of FIGS. 1-6, feed apparatus 10 has a laminating section 90 with a dispensing mechanism, such as the pair of glue applicator heads 92, configured to deposit adhesive on second side section 86, folding section 94 to fold first side sections 84 onto the adhesive on second side section 86 and a compressing section 96 to press second side section 86 onto first side section 84. Laminating section 90 also includes a proximity sensor, not specifically shown, associated with the glue applicator heads 92 to sense the leading edge 98 of container blank 12 and initiate dispensing (i.e., placing a glue bead or spraying) of the glue onto second side section 86 and to sense the trailing edge 50 of container blank 12 to turn off the glue applicator heads 92. In the embodiment shown in the figures, folding section 94 comprises a folding mechanism, such as the pair of folding rails 100, which are configured to plough the first side sections 84 onto the surface of second side sections 86 having the adhesive material therein. As the two surfaces are folded together, the leading edge 98 of container blank 12 is directed into the compression section 96 having compression rollers 102 configured to press the first 84 and second 86 side sections together against guide members 48 so as to allow the bond to completely cure. In the embodiment of FIG. 1, the moving mechanism 28, comprising gripper mechanism 52, directs the container blank through the compression rollers 102 to the second end 30 of feed apparatus 10. As shown in FIG. 10, container blank 12 is directed outwardly from the second end 30 of feed apparatus 10, with trailing edge 50 securely held by gripper 66, such that the trailing edge 50 is then directed downward into the feed rollers of container forming machine 16, for the embodiment of FIG. 1, or directed to the stop members 80 for placement at receiving station 14 of container forming machine 16, as shown in FIG. 10.

Figure 17:
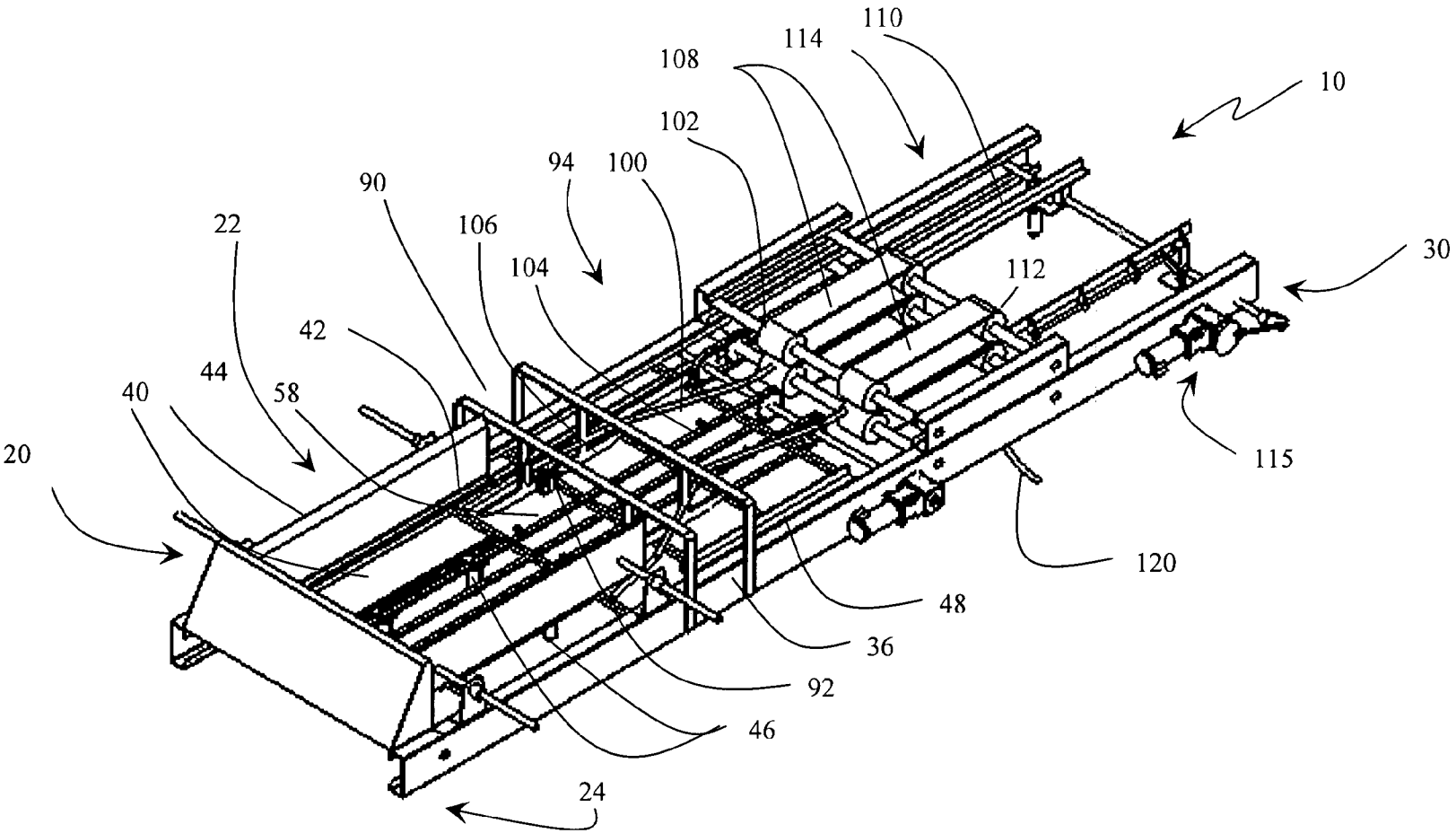
FIG. 17 is a top perspective view of the feed apparatus of FIG. 15 shown without the supporting framework and container blank.
Figure 18:
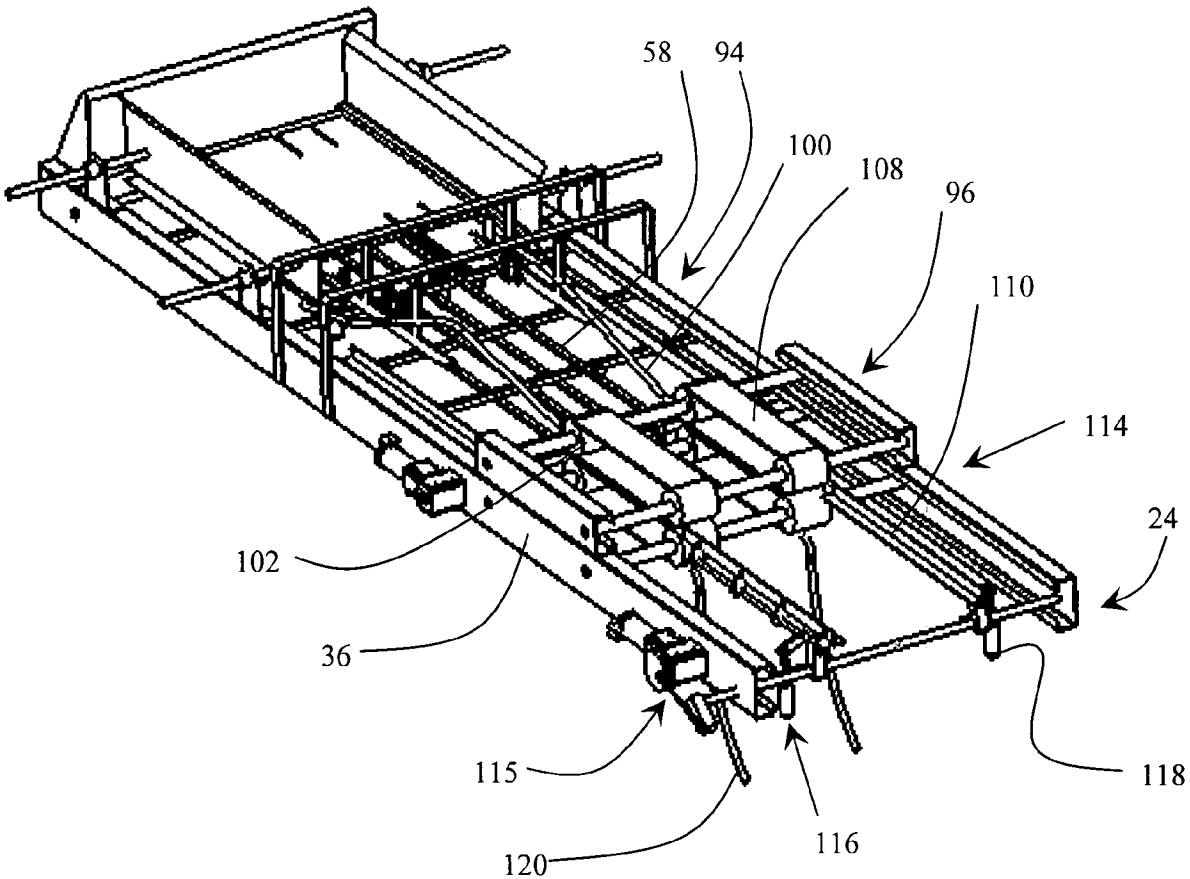
FIG. 18 is a back perspective view of the second end of the feed apparatus of FIG. 16.

In the alternative embodiment of feed apparatus 10 shown in FIGS. 16-19, many of the basic components and operation thereof are similar to that set forth above. A plurality of container blanks 12 are stacked in hopper 22 and supported by ledges 42 on the lower side of the elongated hopper frame members 40 in receiving section 20. When the pneumatic cylinders 46 of selecting mechanism 26 are activated, they extend to direct suction cups 44 against the body of the lowest container blank 12 and suction it against the face of suction cups 44. The pneumatic cylinders 46 retract and deposit the container blank 12 between a pair of guide members 48. The moving mechanism 28 of this embodiment comprises a plurality of spaced apart pusher blocks 104, made out of aluminum or like materials, attached to each of the parallel chains 58, as best shown in FIGS. 16 and 17. The forward motion of pusher blocks 104 contacts trailing edge 50 of container blank 12 to move it forward (i.e., up towards second end 30). As container blank 12 moves forward, the leading edge 98 thereof is sensed by the proximity sensors associated with glue applicator heads 92 in laminating section 90 to trigger the adhesive system, which drops a glue bead in a predetermined position onto the second side sections 86 of container blank 12. As the pusher blocks 104 move container blank 12 forward, the pair of folding rails 100 in folding section 94 begin to plough the first side section 84 onto the second side section 86, through 180 degrees, to allow the inside surface of first side section 84 to make contact with the surface of second side section 86 having the adhesive bead. As the two surfaces meet, the leading edge 98 of container blank 12 is fed between the nip of the two pairs of opposing compression rollers 102 (as opposed to being compressed between compression rollers 102 and guide members 48 for the above-described embodiment), as best shown in FIG. 18. The container blank 12 is held down by two score guides 106, shown in FIG. 17, mounted above frame 36. Pusher blocks 104, together with the movement of compression conveyor belts 108, drive the container blank 12 forward for the length of the compression belts 108, thus allowing the bond to completely cure.

Figure 19:
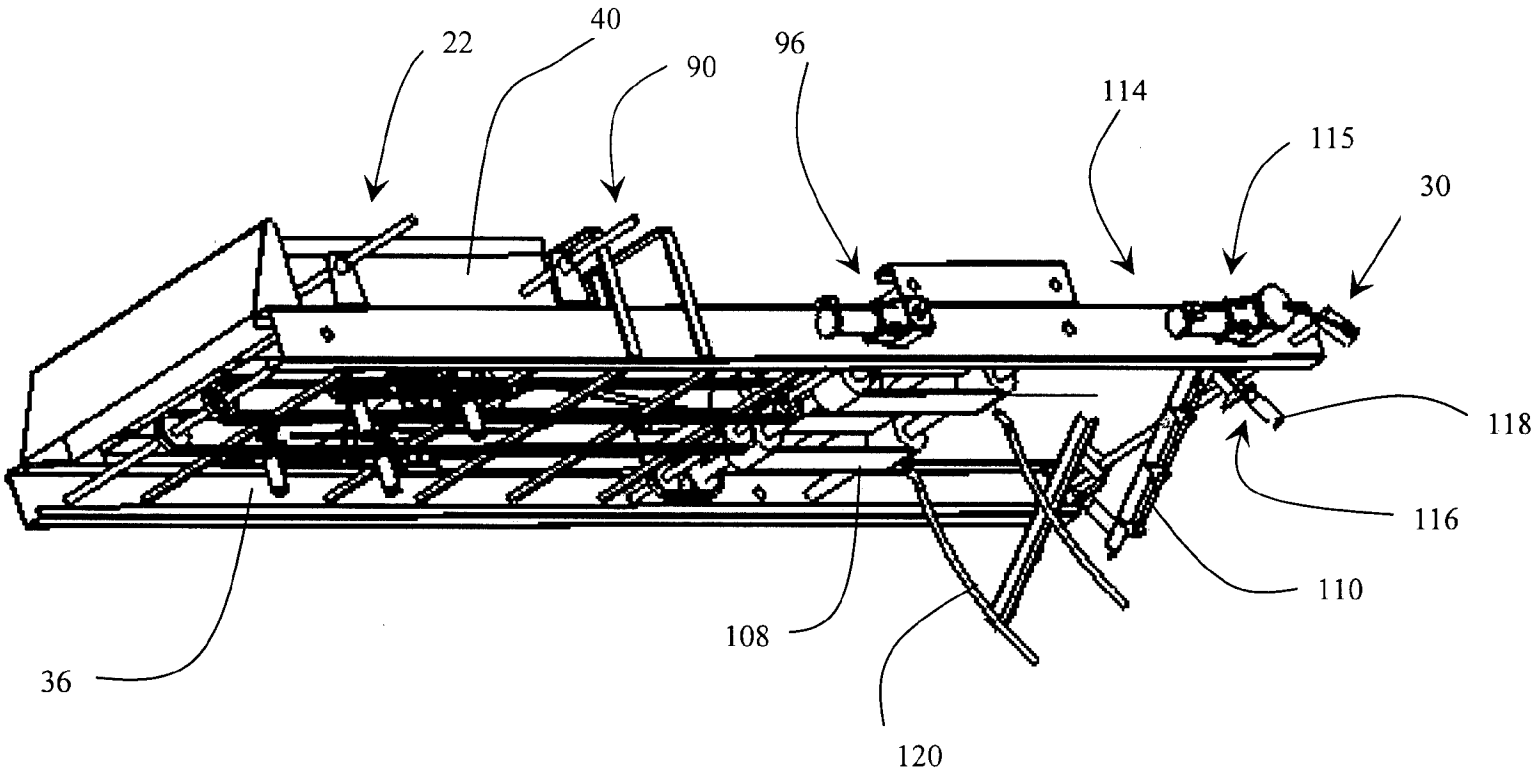
FIG. 19 is a side perspective view of the second end of the feed apparatus of FIG. 16 shown with the oscillation and pivoting mechanisms in operation to lower a blank to the receiving station of a container forming machine.

The container blank 12 exits the conveyor belts 108 of the compression section 96 and is pushed in between two oscillation guides 110. Once the trailing edge 50 of the now-laminated container blank 12 reaches the furthest point on the head pulley 112, the transfer module 114 begins to oscillate in response to oscillator 115 attached to oscillation guides 110 in sequence to the speed of travel of the pusher blocks 104 and the conveyor belts 108. As the oscillation guides 110 begin to oscillate, a guide pivoting mechanism 116, having a pair of pneumatic cylinders 118 in the embodiment shown in the figures, rotates the oscillation guides 110 through 90 degrees, as shown in FIG. 19, to direct container blank 12 to second feed path P2. The horizontal face or bottom ledge of the oscillation guides 110 become the side guide and the vertical face of the angle becomes a pusher, pushing the container blank 12 from the board travel line to the vertical position. During the pushing motion, the trailing edge 50 of container blank 12 rests on a set of guide bars 120, which prevent container blank 12 from falling out of the oscillation guides 110. The trailing edge 50 of container blank 12 becomes the leading edge ready for positioning into the nip of the feed rollers 124, shown in FIG. 16, of the vertical forming machine 16. To achieve this positioning, the guide bars 120 stop short of the vertical guides 122, also shown in FIG. 16, which form part of the receiving station 14 of the vertical container forming machine 16, thus creating a gap directly above the feed rollers 124 through which the container blank 12 is directed into the nip of feed rollers 124. This completes the process and the vertical forming machine 16 continues on to complete the formation of container 18.

While there are shown and described herein a specific embodiment of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use. For instance, there are components described herein that can be replaced with equivalent functioning components to accomplish the objectives of the present invention. One such modification is the use of different materials than those set forth herein.

What is claimed is:

1. A method for feeding a container blank into a receiving station of a container forming machine, said method comprising the steps of:

a) placing a container blank into a hopper;

b) removing said container blank from said hopper;

c) placing said container blank in a first feed path;

d) engaging said container blank with an engaging means attached to a pair of elongated drive members for engaging said container blank;

e) moving said container blank along said first feed path;

f) transferring said container blank from said first feed path to a substantially vertical second feed path; and g) moving said container blank along said second feed path to said receiving station.

2. The method of claim 1, wherein said engaging means comprises at least one pusher block on each of said elongated drive members and said transferring step further comprises placing said container blank on one or more oscillating guides configured to supportably transfer said container blank from said first feed path to said second feed path, said oscillating guides attached operatively connected to a guide pivoting means for pivoting said one or more oscillating guides to substantially vertically dispose said container blank at said receiving station and operatively connected to an oscillator configured to oscillate said container blank.

3. The method of claim 1, wherein said engaging means is on a shaft interconnecting said pair of drive members, said engaging means comprising a means for gripping said container blank, said gripping means configured to securely grip said container blank through said first feed path and said second feed path until said container blank is in position to be received in said receiving station.

4. The method of claim 3 further comprising a pivoting means operatively connected to said shaft for pivoting said shaft, wherein said shaft is pivotally attached to said drive members and said gripping means is fixedly attached to said shaft.

5. The method of claim 4, wherein said gripping means comprises a gripper having a first grip member and a second grip member biased together to securely grip at least a portion of said container blank, said gripping having a gripper opening means associated therewith for selectively opening said gripper to receive said portion of said container blank in said gripper and to release said container blank therefrom at said receiving station.

6. The method of claim 1 further comprising the steps dispensing an adhesive on said container blank, folding a side section of said container blank onto said adhesive and compressing said side section against said adhesive prior to said transferring step.

7. A feed apparatus for feeding a container blank into a receiving station of a container forming machine, said feed apparatus comprising:

a receiving section at a first end of said feed apparatus, said receiving section having a hopper for holding said container blank;

means for selecting said container blank from said hopper;

means for moving said container blank from said receiving section towards a second end of said feed apparatus, said moving means having one or more elongated drive members and an engaging means associated with said drive members for engaging said container blank, said moving means configured to move said container blank along a first feed path to said second end of said feed apparatus and along a second feed path into said receiving station; and means at said second end of said feed apparatus for transferring said container blank from said first feed path to said second feed path.

8. The feed apparatus of claim 7, wherein said second feed path is substantially vertical.

9. The feed apparatus of claim 8, wherein said first feed path is angled upwardly from said first end to said second end of said feed apparatus.

10. The feed apparatus of claim 8, wherein second feed path is configured to vertically feed said container blank into one or more feed rollers of said container forming machine.

11. The feed apparatus of claim 7, wherein said transferring means disposes said container blank outwardly from said second end of said feed apparatus prior to lowering said container blank into said receiving station.

12. The feed apparatus of claim 7 further comprising a shaft interconnecting a pair of said drive members, said engaging means on said shaft, wherein said engaging means comprises a means for gripping said container blank, said gripping means configured to securely grip said container blank through said first feed path and said second feed path until said container blank is in position to be received in said receiving station.

13. The feed apparatus of claim 12 further comprising a pivoting means operatively connected to said gripping means for pivoting said gripping means so as to dispose said container blank in a substantially vertical position at said second end of said feed apparatus.

14. The feed apparatus of claim 13, wherein said shaft is pivotally attached to said drive members, said gripping means is fixedly attached to said shaft and said pivoting means is configured to pivot said shaft to pivot said gripping means.

15. The feed apparatus of claim 12, wherein said gripping means comprises a gripper having a first grip member and a second grip member biased together to securely grip at least a portion of said container blank, said moving means further comprising a gripper opening means for selectively opening said gripper at said first end of said feed apparatus to receive said portion of said container blank in said gripper and to release said container blank therefrom at said receiving station.

16. The feed apparatus of claim 15, wherein said shaft is pivotally attached to said drive members and said gripper is fixedly attached to said shaft, said feed apparatus further comprising a pivoting means operatively attached to said shaft for pivoting said shaft so as to pivot said gripper and dispose said container blank in a substantially vertical position at said second end of said feed apparatus.

17. The feed apparatus of claim 7 further comprising a laminating section having a means of dispensing an adhesive on said container blank, a folding section having a means of folding a side section of said container blank onto said adhesive and a compressing section having one or more compression rollers to compress said side section against said adhesive.

18. The feed apparatus of claim 17, further comprising one or more guide members configured to support said container blank through at least a portion of said first feed path, said compression roller configured to compress said container blank against at least one of said one or more guide members.

19. The feed apparatus of claim 17 further comprising one or more conveyor belts operatively attached to said compression rollers, said conveyor belts configured to move said container blank from said compression rollers to said transferring means.

20. The feed apparatus of claim 7, wherein said engaging means comprises at least one pusher block on each of said elongated drive members.

21. The feed apparatus of claim 20, wherein said transferring means comprises one or more oscillating guides configured to supportably transfer said container blank from said first feed path to said second feed path.

22. The feed apparatus of claim 21, wherein said transferring means further comprises a guide pivoting means for pivoting said one or more oscillating guides to substantially vertically dispose said container blank.

23. The feed apparatus of claim 22, wherein said transferring means comprises an oscillator attached to at least one of said one or more oscillating guides, said oscillator configured to oscillate said container blank.

24. A feed apparatus for feeding a container blank into a receiving station of a container forming machine, said feed apparatus comprising:

a receiving section at a first end of said feed apparatus, said receiving section having a hopper for holding said container blank;

means for selecting said container blank from said hopper;

means for moving said container blank from said receiving section towards a second end of said feed apparatus, said moving means having a pair of elongated drive members, a shaft interconnecting said pair of drive members and a gripping means on said shaft for securely gripping said container blank, said moving means configured to move said container blank along a first feed path to said second end of said feed apparatus and along a second feed path into said receiving station, said second feed path being substantially vertical to vertically feed said container blank into said receiving station; and means at said second end of said feed apparatus for transferring said container blank from said first feed path to said second feed path.

25. The feed apparatus of claim 24 further comprising a pivoting means operatively connected to said shaft for pivoting said gripping means so as to dispose said container blank in a substantially vertical position at said second end of said feed apparatus, wherein said shaft is pivotally attached to said drive members and said gripping means is fixedly attached to said shaft.

26. The feed apparatus of claim 25, wherein said gripping means comprises a gripper having a first grip member and a second grip member biased together to securely grip at least a portion of said container blank, said moving means further comprising a gripper opening means for selectively opening said gripper at said first end of said feed apparatus to receive said portion of said container blank in said gripper and to release said container blank therefrom at said receiving station.

27. The feed apparatus of claim 24 further comprising a laminating section having a means of dispensing an adhesive on said container blank, a folding section having a means of folding a side section of said container blank onto said adhesive and a compressing section having one or more compression rollers to compress said side section against said adhesive.

* * * * *